United States Patent [19]

Zima

[11] Patent Number: 4,570,395

[45] Date of Patent: Feb. 18, 1986

[54] EARTHQUAKE RESISTANT SELF-BALANCING DOME STRUCTURE

[76] Inventor: John P. Zima, 25058 N. Chestnut St., Newhall, Calif. 91321

[21] Appl. No.: 553,699

[22] Filed: Nov. 21, 1983

[51] Int. Cl.[4] ..... E04B 7/14

[52] U.S. Cl. ..... 52/83; 52/63; 52/222; 135/120

[58] Field of Search ..... 52/83, 63, 222, 2 P, 52/162; 135/120, 102; 14/22, 36, 39

[56] References Cited

U.S. PATENT DOCUMENTS 1,481,019 1/1924 Luebbert ..... 189/1.5

FOREIGN PATENT DOCUMENTS 1256396 12/1967 Fed. Rep. of Germany ..... 52/2 P
6801792 8/1968 Netherlands ..... 52/83
711225 1/1980 U.S.S.R. ..... 14/22

*Primary Examiner*—Carl D. Friedman
*Assistant Examiner*—Naoko N. Slack
*Attorney, Agent, or Firm*—Poms, Smith, Lande & Rose

[57] ABSTRACT

An earthquake resistant self-balancing dome structure is provided which employs a counter-balanced self-adjusting weight system to adjust tension in supporting cables to which the dome is attached. As ground movement, such as that caused by an earthquake, causes relative movement between the cable supports and the supported dome, the weight system operates to adjust the tensile force in the cables to bring the system into equilibrium.

10 Claims, 5 Drawing Figures

EARTHQUAKE RESISTANT SELF-BALANCING DOME STRUCTURE

FIELD OF THE INVENTION

This invention relates to domed structures wherein the roof is supported by cables, and more particularly, to cable supported dome structure which compensate for stresses induced by ground movement, such as those occurring during earthquakes.

BACKGROUND OF THE INVENTION

Many structures have been proposed heretofore for supporting roofs by means of cables. Typical of such arrangements are the structures shown in U.S. Pat. Nos. 2,921,592 for an air inflated structure, 3,288,158 for a movable roof structure, 3,613,322 for a cable supported roof, 3,994,108 for a tower structure, and 4,068,404 for a shade producing structure. Other domed structures of more rigid construction include the Superdome in New Orleans, La. and the Astrodome outside of Houston, Tx. In most of these structures, however, the roof is either rigidly supported, or in the case of the cable supported roofs, the cables are fixed in their positions relative to the roof and the cable supporting members, once the roof is in place. Accordingly, in the event of ground movement, as in an earthquake, the structures would have little "give" or accommodation to the shock, and might well collapse as the result of such an earth tremor.

Accordingly, a principal object of the present invention is to provide a cable supported dome structure which is self-balancing and earthquake resistant.

SUMMARY OF THE INVENTION

In accordance with a broad aspect of the invention, a domed roof is supported by a plurality of cables fastened to the dome. The cables are elevated above the ground on support means or columns, and the cables are self-adjustable in response to movement of the support means relative to the dome, so that in the event of an earth tremor or other earth movement, the cables may move with respect to the supports to adjust for the earth movement.

In accordance with another aspect of the invention, a counterbalanced self-adjusting weight system is employed to balance load changes in the supporting cables, when tension in the cables changes due to relative movement between the cable supports and the dome.

In accordance with another aspect of the invention, guide means are provided on the support means for permitting the supporting cables to move relative to the support means, as the self-adjusting weight system operates to balance load changes experienced by the cables.

In yet another aspect of the invention, the ends of one or more of the supporting cables are extended over opposed guide means and downwardly toward the ground, with a plurality of weights attached to each downward extension of the supporting cables. A number of these weights are supported on rests so that these supported weights do not exert any tension in the cable. Additional weights are unsupported by rests, and exert a force or pull on the cable. When relative movement occurs between the cable supports and the dome, some of the weights are either lifted off or are deposited on their associated rests, altering tension in the cable, compensating for the load changes induced by the ground movement, and providing a restoring force to bring the position of the dome back toward its original position.

In accordance with another aspect of the invention, the guide means may each include a tubular channel through which the supporting cable passes and relative to which the cable may move in a sliding manner.

In accordance with a further aspect of the invention, the dome may be constructed of flexible material.

In yet another aspect of the invention, the support means supporting the cables includes a plurality of columns spaced around the periphery of the dome, over which the cables are positioned.

In accordance with another aspect of the invention, additional cables are provided to extend between the supporting cables to provide additional support to the dome.

In accordance with a further aspect of the invention, a strut may extend upwardly at the center of the dome from the supporting cables to increase the height of the dome above the supporting cables.

Other objects, features, and advantages of the invention will become apparent from a consideration of the following detailed description and the accompanying drawings.

DETAILED DESCRIPTION OF THE DRAWINGS

Figure 3:
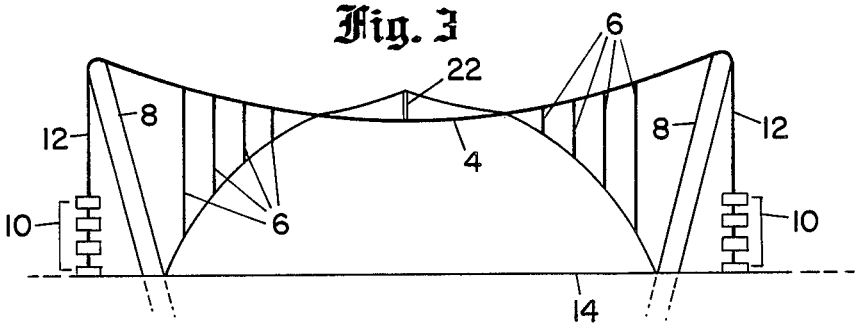
FIG. 3 is a cross-sectional view of an alternative embodiment of the present invention, showing a strut being employed to raise the height of the dome above the supporting cables.

A preferred embodiment of an earthquake resistant self-balancing dome structure is shown in FIGS. 1, 2, 4 and 5. FIG. 3 depicts an alternative embodiment wherein a strut is used to raise the height of the dome above the supporting cables.

In the preferred embodiment, a dome 2 is supported by a plurality of supporting cables 4, which in conjunction with the vertical cables 6 support dome 2. The supporting cables 4 are essentially catenaries, the curve of which may be slightly altered because of the forces exerted by vertical cables 6.

Support means for elevating the supporting cables above the ground are shown in the drawings as a plurality of columns 8 around the periphery of the dome. The columns 8 will generally follow the exterior shape of the dome, and accordingly, may be arranged in an elliptical or a square pattern as required.

The dome 2 is fastened to the supporting cables 4 by means for fastening or vertical cables 6 extending from the supporting cables 4 to the dome 2. In the preferred embodiment, both the supporting cables 4 and the vertical cables 6 are steel cables appropriately sized to support the weight of the dome 2.

It can be seen that a dome structure having the essential features described thus far would be susceptible to great damage in the event that ground movement, such as that caused by an earthquake, caused the columns 8 to move relative to one another and relative to dome 2. The forces in the supporting cables 4 could increase or decrease to a large extent, transmitting significant forces to dome 2 in an irregular pattern causing points of severe stress, which could result in failure of portions of the dome, or the collapse of the entire dome, in the event the cables detached from the dome.

To solve this problem, the present invention utilizes a means for adjusting the supporting cables 4 in response to movement of the columns 8 relative to the dome 2. In the preferred embodiment, this adjusting means includes weights 10 which counter-balance the weight of the dome and are self-adjusting to balance load changes in the supporting cables 4.

More specifically, each of the supporting cables 4 have end portions 12 to which a plurality of weights 10 are attached. A predetermined number of weights 10 are supported on rest means, which in the preferred embodiment is the ground 14, and a second predetermined number of weights 10 are left suspended above the rest or the ground 14 thereby exerting a force on the supporting cable 4, causing the supporting cable 4 to be in tension. A proper number of weights are chosen to cause enough tension in the supporting cables 4 so that the supporting cables 4 will exert sufficient force to support dome 2.

When relative movement occurs between one or more columns 8 and the dome 2, the equilibrium of the system is effected causing one or more weights 10 to be lifted from the ground 14, or be deposited on the ground 14, thereby causing the system to once again come into equilibrium.

Movement of the supporting cables 4 over the columns 8 is facilitated by a guide means on each column 8, which in the preferred embodiment is a tubular metal channel 16 through which the supporting cable 4 passes. The guide means may also be a sheave or pulley, or any other means to allow guided movement of the supporting cable 4 as the weights 10 of the adjusting means operate to equalize forces due to the relative movement between the dome 2 and the columns 8. In the preferred embodiment, the tubular channel 16 is affixed to the column 8 by means of metal straps 18 anchored into the column 8, which may, for example be a reinforced concrete pillar.

Figure 1:
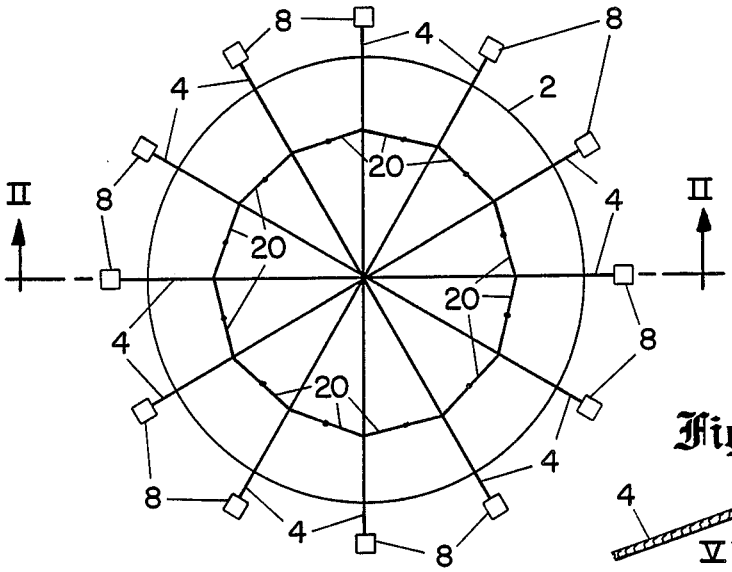
FIG. 1 is a top view of a representation of a preferred embodiment of a self-balancing dome.
Figure 4:
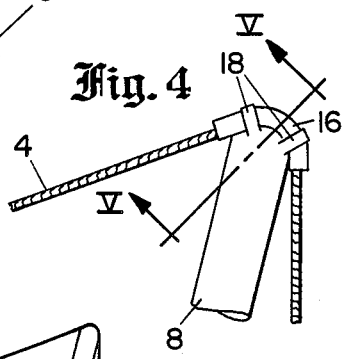
FIG. 4 is a side view of a supporting column and its associated guide means.
Figure 2:
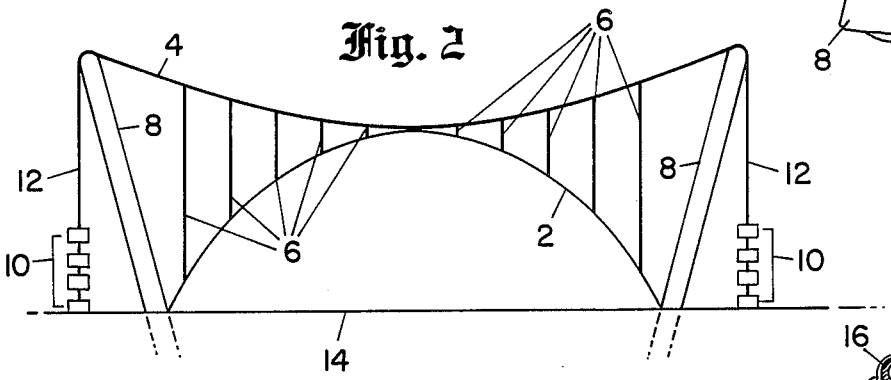
FIG. 2 is a section view through plane II—II of FIG. 1.
Figure 5:
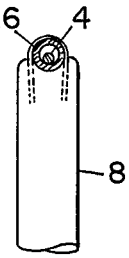
FIG. 5 is a section view through plane V—V of FIG. 4.

FIG. 1 shows optional inner-connecting cables 20 which interconnect the supporting cables 4 and loop downward and are secured to the dome 2 to support the dome between the supporting cables 4.

FIG. 3 depicts an alternative embodiment of the dome structure, wherein a compression strut 22 extends upwardly at the center of the dome from the supporting cables 4 to increase the height of the dome above the supporting cables 4. This allows the height of dome 2 to approach or even exceed the height of the columns 8, saving construction and material costs. The upper end of the strut 22 may be held in place by supplemental wires or cables, or by the material of the dome itself.

In the preferred embodiment, the columns 8 are inclined at an angle so that the only force exerted on each column 8 is a compressive force through the center of each column 8. If the columns were vertical, they would experience not only a compressive force but also a bending force, requiring them to be of a greater diameter to withstand the additional force.

The dome 2 may either be constructed from a flexible material such as nylon, canvas or other flexible material, or it may be made of lightweight sheet material such as fiberglass reinforced plastic, very thin weatherproof plywood, or similar material of relatively high strength but which may be semi-rigid but still capble of flexing or bending without breaking. The dome 2 may also include resilient portions which can be freely stretched or compressed as the forces being applied to the dome through the cables change during ground movement as in an earthquake.

In another alternative embodiment, the support means, instead of being columns 8, may be some other construction such as a wall or an athletic stadium having upper supports and a relatively flatter dome structure with its outer edges terminating above the highest seats.

It is to be understood that the disclosed apparatus is merely illustrative of the principles of the present invention which could be implemented by other types of structures than what is depicted in the drawings. Examples of such alternative embodiments were described above. More generally, the present invention contemplates the use of a structure where a domed structure has its lower edges free, or only resiliently restrained, and the entire dome free to shift position in the event of earth tremors or other ground instability; and alternative cable support arrangements to implement this concept may be employed. By way of example and not of limitation, the columns could be hollow, and the weights mounted to move up and down within the hollow support columns. Accordingly, the scope of the present invention is not limited to the embodiments as shown in the drawings and specifically described herein.

What is claimed is:

1. An earthquake resistant self-balancing dome structure comprising:

a flexible light weight dome;

a plurality of supports spaced around said dome;

a plurality of cable means extending over said supports, each having at least one outer end located at a point on said cable means away from said dome, at least one outer portion located in a region of said cable means immediately inward of and adjacent to said outer end, and at least one inner portion located in a region of said cable means inward of said outer portion and being secured to said dome to support it;

said cable means being free to make limited controlled movement over said supports;

a plurality of weights secured to the outer ends of each of said cable means; and means for supporting said weights on said cable means with at least one of said weights engaging a rest means for said one weight, and others of said weights being located close to rests whereby movements of the outer portion of said cable means in one direction or the other will increase or decrease tension on said cable means.

2. A dome structure as defined in claim 1 wherein additional cables are provided to extend between said cable means to support said dome between said cable means.

3. A dome structure as defined in claim 1 wherein a strut means extends upwardly at the center of said dome from said cable means to increase the height of said dome above said cable means.

4. A self-balancing dome structure comprising: 'a dome;

a plurality of supporting cables for supporting the dome;

support means for elevating the supporting cables above the ground;

means for fastening the dome to the supporting cables; and means for adjusting the supporting cables in response to movement of the dome relative to the support means, said adjusting means including weights in a counter-balanced, self-adjusting system to balance load changes in the supporting cables.

5. The dome structure of claim 4 wherein the adjusting means includes guide means on the support means for permitting the supporting cables to move relative to the support means, as the weight system operates to balance load changes.

6. The dome structure of claim 5 further comprising:

one or more supporting cables having ends extending over opposed guide means and downwardly toward the ground, with a plurality of said weights attached to each downward extension of the supporting cable;

rest means supporting one or more of said weights on each downward extension so that the supported weights do not exert any tension in the cable;

whereby when relative movement occurs between the support means and the dome, a predetermined number of said weights are either lifted off or are deposited on their associated rest means, altering the tension in the cable.

7. The dome structure of claim 5 wherein the guide means includes a tubular channel through which the cable passes, and relative to which the cable slidingly moves.

8. A dome structure comprising:

a dome;

a plurality of supporting cables for supporting the dome;

a plurality of columns spaced around the periphery of the dome for elevating the supporting cables above the ground;

means for fastening the dome to the supporting cables;

ends on one or more supporting cables extending over opposed columns and downwardly toward the ground;

weight means attached to said ends to balance the weight of said dome;

rest means supporting one or more of said weight means so that the supported weight means do not exert any tension in the cable; and guide means on the columns for permitting the supporting cables to move relative to the support means;

whereby when relative movement occurs between one or more columns and the dome, a predetermined number of said weight means are either lifted off or deposited on their associated rest means, altering the tension in the affected supporting cables.

9. A dome structure as defined in claim 8 wherein each said cable ends has a plurality of weights coupled thereto, and wherein at least one of said weights on each cable end is supported by a rest means.

10. A self-balancing dome structure comprising:

a dome;

a plurality of supporting cables for supporting the dome;

strut means extending upwardly at the center of said dome from said supporting cables to increase the height of said dome above said supporting cables;

support means for elevating the supporting cables above the ground;

means for fastening the dome to the supporting cables; and means for adjusting the supporting cables in response to movement of the support means relative to the dome.

* * * * *